US009784533B2

(12) United States Patent
Mock et al.

(10) Patent No.: US 9,784,533 B2
(45) Date of Patent: Oct. 10, 2017

(54) COMPACT SPRING GUIDE ROD LASER

(71) Applicant: Crosman Corporation, Bloomfield, NY (US)

(72) Inventors: Jeffrey W. Mock, Rochester, NY (US); John A. Kowalczyk, Jr., Fairport, NY (US); Kenneth R. Vorndran, West Henrietta, NY (US); Michael W. Allen, Shortsville, NY (US); Robert J. MacBlane, Farmington, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 15/001,787

(22) Filed: Jan. 20, 2016

(65) Prior Publication Data

US 2016/0209170 A1 Jul. 21, 2016

Related U.S. Application Data

(60) Provisional application No. 62/105,721, filed on Jan. 20, 2015.

(51) Int. Cl.
*F41G 1/35* (2006.01)
*F41G 11/00* (2006.01)

(52) U.S. Cl.
CPC ..... *F41G 1/35* (2013.01); *F41G 11/001* (2013.01)

(58) Field of Classification Search
CPC ..... F41G 1/34; F41G 1/35; F41G 1/36; F41G 11/00; F41G 11/001; H05B 37/02; F21L 4/00; F21L 4/04
(Continued)

(56) References Cited

U.S. PATENT DOCUMENTS 3,655,192 A * 4/1972 Hall ..... F41G 3/2683 200/34
4,102,059 A * 7/1978 Kimble ..... F41A 33/02 362/113

(Continued)

*Primary Examiner* — Jonathan C Weber
(74) *Attorney, Agent, or Firm* — Roland R. Schindler II; Dominic Ciminello; Lee & Hayes, PPLC

(57) ABSTRACT

Laser systems are provided. In one aspect a laser system has a battery unit and a transistor having a source and a drain in series with the laser and the battery unit with the laser with the transistor having a source, and a gate that allows sufficient current to flow to the laser to allow the laser to emit light when a voltage at the gate is at a higher level and that does not allow sufficient current to flow to allow the laser to emit light when a voltage at the gate is at a lower level. A microcontroller is operable in an active mode and a reduced power mode having an activation input connected to a switch, a reduced power input connected in parallel with the capacitor and an output connected to the gate. When the switch changes from a first state to a second state, the microcontroller enters an active mode generating a plurality of micro-pulses at the gate such that an active current is supplied that cause the laser to emit a continuous plurality of micro-pulses that when viewed by a human observer provide an apparently continuous laser pulse and when the micro-controller enters a power down mode, no micro-pulses are provided at the gate and a leakage current through the laser provides energy to maintain the processor in the power down mode of activation until the switch is again closed.

12 Claims, 17 Drawing Sheets

(58) Field of Classification Search
USPC ..... 42/114, 115, 117, 146, 90; 315/158; 362/109–114, 183, 184, 200, 202, 208, 362/259
See application file for complete search history.

(56) References Cited

U.S. PATENT DOCUMENTS 4,934,086 A * 6/1990 Houde-Walter ..... F41G 1/35 362/110
5,355,608 A * 10/1994 Teetzel ..... F41A 9/62 362/113
5,388,364 A * 2/1995 Paldino ..... F41G 1/35 362/114
5,392,550 A * 2/1995 Moore ..... F41G 1/35 362/110
5,419,072 A * 5/1995 Moore ..... F41G 1/35 362/114
5,509,226 A * 4/1996 Houde-Walter ..... F41G 1/35 362/110
5,531,040 A * 7/1996 Moore ..... F41G 1/35 362/114
5,694,713 A * 12/1997 Paldino ..... F41G 1/35 33/DIG. 21
6,892,488 B1 * 5/2005 Serravalle ..... F41A 5/02 42/113
7,937,880 B1 * 5/2011 Fidlow ..... F41A 17/06 396/426
8,510,982 B1 * 8/2013 Squires ..... F41G 1/35 42/113
9,368,936 B1 * 6/2016 Lenius ..... G01S 17/32
2005/0252061 A1 * 11/2005 Sloan ..... F41A 19/47 42/114
2008/0066362 A1 * 3/2008 Fidlow ..... F41A 17/06 42/90
2014/0130394 A1 * 5/2014 Kowalczyk, Jr. ..... F41A 5/02 42/114

* cited by examiner

COMPACT SPRING GUIDE ROD LASER

CROSS-REFERENCE TO RELATED APPLICATIONS

This application claims the benefit of U.S. Provisional Application No. 62/105,721 filed Jan. 20, 2015.

FIELD OF THE INVENTION

This invention relates, in general, to laser sights for firearms, and, in particular, to self-aligned laser sights which are easily installed, are ambidextrously operated, and have prolonged battery life.

BACKGROUND

In U.S. Pat. No. 4,934,086, there is shown a firearm, in particular a pistol, in which a laser sight is mounted in a recoil spring guide chamber. Laser sights are often used by law enforcement authorities in order to enhance the negotiating position of a law enforcement officer when confronting a party subject to arrest. It is reported that once a party subject to arrest recognizes that the party has been targeted with a laser sight, such parties often cease further resistance to arrest and relinquish their own firearms. So, there is a need for a laser sight in such situations.

Certain firearms are not equipped with safety latches. Law enforcement officers are trained to withdraw such a firearm from its holster and place a trigger finger along the recoil spring guide chamber of the firearm. Such technique reduces the cases of inadvertent firing of the firearm. However, it would be desirable to provide the law enforcement officer with a positive reinforcement for this training technique.

There is also a need for a laser sight which may be quickly installed in a pistol without requiring substantial modification of the firearm. Most laser sights for pistols have been accessories that are added by the pistol owner and not by the manufacturer. Such laser sight accessories often require substantial modification of the pistol in order to accommodate the laser sight. In some cases, the modification the extent of the modifications is such that the pistol manufacturer will not further honor the original warranty that was made in connection with the sale of the pistol. Alternatively, lasers can be joined to an exterior of the firearm changing the size, weight and feel of the firearm and requiring use of non-standard holsters. As such, it is desirable to have a laser sight accessory which requires minimal modifications of the pistol so that the original manufacturer warranty is maintained and so that the laser sight can be rapidly installed by the pistol owner or user without requiring installation by a trained technician.

There has also developed a need for a long lasting laser sight. Because current lasers require substantial power, laser sights have been of unduly large size in order to accommodate power supplies needed to maintain the laser in an operating condition for a reasonable amount of time such as 30 minutes. So, the users of laser sights have been faced with the dilemma of shrinking the size of the laser sight but reducing the overall operating life of the battery or having a larger sight that can accommodate a larger battery and thus a longer life. As such, there is a need for a relatively small laser sight with a small power source or battery that lasts for 30 minutes or more.

U.S. Pat. No. 5,509,226 describes one solution to this problem—the spring guide rod laser. This patent describes a laser sight that is disposed substantially entirely within the recoil spring guide chamber of a firearm, such as the recoil cavity of a pistol. As is schematically illustrated in FIGS. 1A and 1B this prior art spring guide rod laser sight 2 has a housing 4 with the following components arranged from back to front—batteries 6 that are electrically connected at one terminal to a battery pin 9 and at another terminal to a high value capacitor 8. A control circuit 10 is electrically connected battery pin 9 by way of capacitor 8. Three leads 11 are carefully soldered to provide a path between control circuit 10 and a laser 12.

Laser 12 generates light when activated by control circuit 10 and this light passes through optics 14 to create a more collimated laser emission. In a spring guide rod laser, housing 4 is sized and shaped based upon a recoil spring guide rod for a firearm and can be substituted for the manufacturer's recoil spring guide rod. A portion of housing 4 proximate lens 14 extends outside of the firearm so that light emitted by laser 12 passes outside of the firearm. Because the spring guide rod is typically co-aligned with an axis of a barrel of a firearm light from the laser is typically placed proximate where a firearm will fire.

A modified take down latch 16 on the firearm is movable from an off position shown in FIG. 1A where a non-conductive portion 18 of a take down latch 16 blocks current from traveling between a battery pin and a conductive path 24 leading to laser 12 and a position where a closed circuit can exist between batteries 6, a battery pin 9, a first conductive surface 14, a second conductive surface 22, a conductive path 24, and laser 12. In FIGS. 1A and 1B conductive path 24 is shown in block form but includes components of the firearm in which spring guide rod laser sight 2 is located such as a recoil chamber of the firearm, and a recoil spring. This introduces potential variability in the electrical path complicating the design of spring guide rod laser sight 2.

The spring guide rod laser allows a laser sight to be incorporated into a pistol without substantially changing the look, feel, or handling of the firearm. While such spring guide rod lasers are technically and commercially successful, it remains desirable to offer new models which can offer advantages such as reducing any or all of the size, complexity and cost of such spring guide rod lasers, reducing manufacturing and product costs, offering more user control over a mode of operation of the spring guide laser, providing improved electrical performance, or improving runtime performance. Of particular interest is making spring guide rod lasers available for use in smaller sized handguns that have relatively small guide rods.

Conventionally, there are many challenges in trying to improve upon the successful design of the prior art spring guide rod lasers. One problem faced is that the small batteries of a size that can be incorporated into a guide rod must also be of a type that is not rapidly self-discharging so that they can be incorporated into the spring guide rod laser and then used weeks, months or even years later. However, such batteries must also be capable of providing sufficient power to allow a laser to generate a laser beam that is visible from a great range when activated. This places a high drain on such batteries requiring significant capacitors that add size and weight to the spring guide rod laser. Additionally, the use of the take down latch and components of the firearm as conductive elements in the system can introduce resistance into the circuit at the points of contact between the spring guide rod laser and the firearm components as well as at points of contact between firearm components that are used to provide such electrical paths. This resistance can add to the burdens placed on the batteries and capacitors.

What are needed in the art are spring guide rod lasers that can overcome such difficulties to enable any of smaller, less expensive, more efficient, longer running, less complex and more feature rich spring guide rod lasers.

Additionally, it has been common for spring guide rod lasers of the prior art to have only one mode of operation—a periodic mode. There have been many reasons for this, one reason for this is that the drive circuit must reliably activate and operate as intended from a powered off state thus introducing mode selection can create unintended issues when start up occurs. Another reason for this is that it is not a trivial matter to provide user access to a mode selector that is to control a circuit that is housed within the central portion of a spring guide rod housing. It also will be understood that it is not a trivial matter to provide a mode selector that will maintain a setting even when exposed to the extreme environment within a firearm spring guide chamber. Further, there are users who will prefer to have the option to change settings without having to access the spring guide rod.

Thus what is also needed in the art is a compact, efficient, reliable, less complex and less expensive spring guide rod laser that can allow a user to select a mode of operation while the spring guide laser is installed in the firearm.

BRIEF SUMMARY OF THE INVENTION

Laser systems are provided. In one aspect a laser system has a battery unit and a transistor having a source and a drain in series with the laser and the battery unit with the laser with the transistor having a source, and a gate that allows sufficient current to flow to the laser to allow the laser to emit light when a voltage at the gate is at a higher level and that does not allow sufficient current to flow to allow the laser to emit light when a voltage at the gate is at a lower level. A microcontroller is operable in an active mode and a reduced power mode having an activation input connected to a switch, a reduced power input connected in parallel with the capacitor and an output connected to the gate. When the switch changes from a first state to a second state, the microcontroller enters an active mode generating a plurality of micro-pulses at the gate such that an active current is supplied that cause the laser to emit a continuous plurality of micro-pulses that when viewed by a human observer provide an apparently continuous laser pulse and when the microcontroller enters a power down mode, no micro-pulses are provided at the gate and a leakage current through the laser provides energy to maintain the processor in the power down mode of activation until the switch is again closed.

In another aspect a laser system comprises a housing operable as a spring guide rod in a firearm and having a first opening at a first end and a second end, a laser positioned in the housing to emit light from the first end of the housing, a control system positioned proximate second end and a battery unit between control system and the laser, the battery unit being electrically connected at a first terminal to a laser, and at a second terminal to the control system. The battery unit is electrically insulated from the housing and the laser and control system are electrically connected to the housing so that the control system can control operation of the laser by controlling current flow between the laser and the second terminal of the battery unit without current flowing through a firearm component.

DETAILED DESCRIPTION OF THE INVENTION

Figure 2:
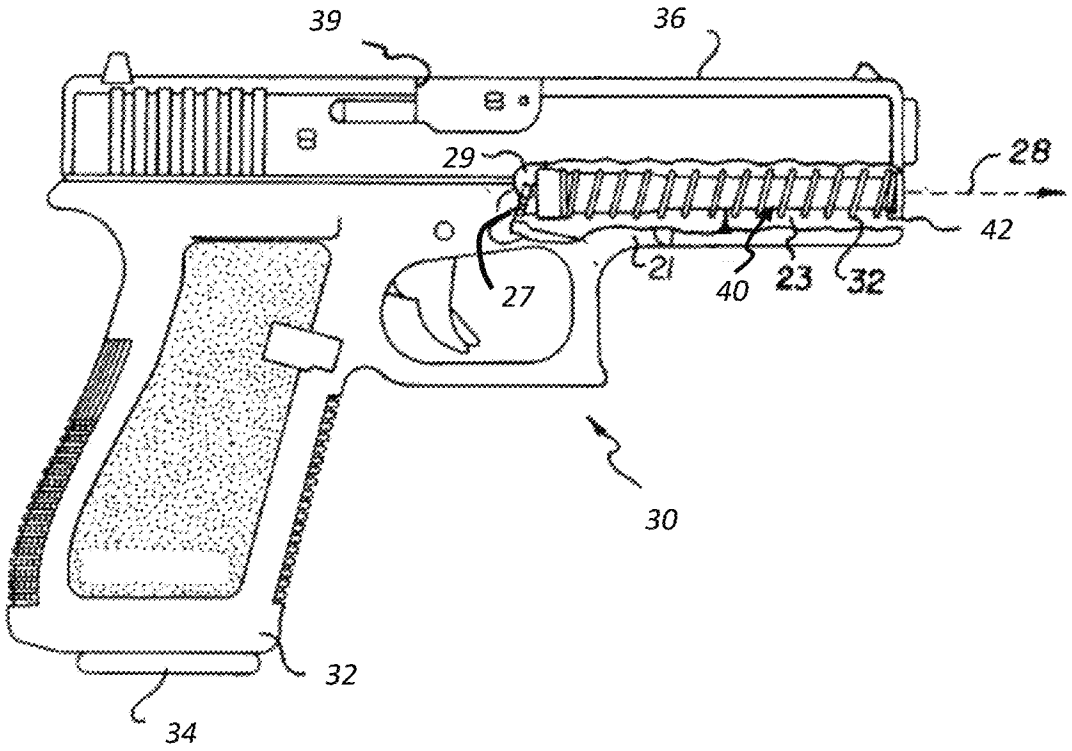
FIG. 2 PRIOR ART
FIG. 2 illustrates a firearm.

With reference to FIG. 2 there is generally shown a firearm 30. Typical of such a firearm is the Glock 17/17L/18/19/20/21 and 22 semi-automatic pistol manufactured by Glock, GMBH of Austria. In firearm 30, a pistol grip frame 32 holds a magazine 34 which contains a number of rounds of ammunition. The ammunition is spring biased in a direction toward the structure 36 containing a reciprocating chamber. Cartridges from spent rounds are ejected through ejection slot 39 of structure 36 when structure 36 moves to the left or backward along axis 28 with respect to pistol grip frame 32 under the recoil action following discharge of firearm 30. Structure 36 is coupled to pistol grip frame 32 via a take down latch 27 which is mated to a catch 29 that is integral with structure 36. Disposed between structure 36 and frame 21 is a recoil chamber 23. Within recoil chamber 23 is a spring guide rod laser sight 40 surrounded by a recoil spring 42.

Figure 3:
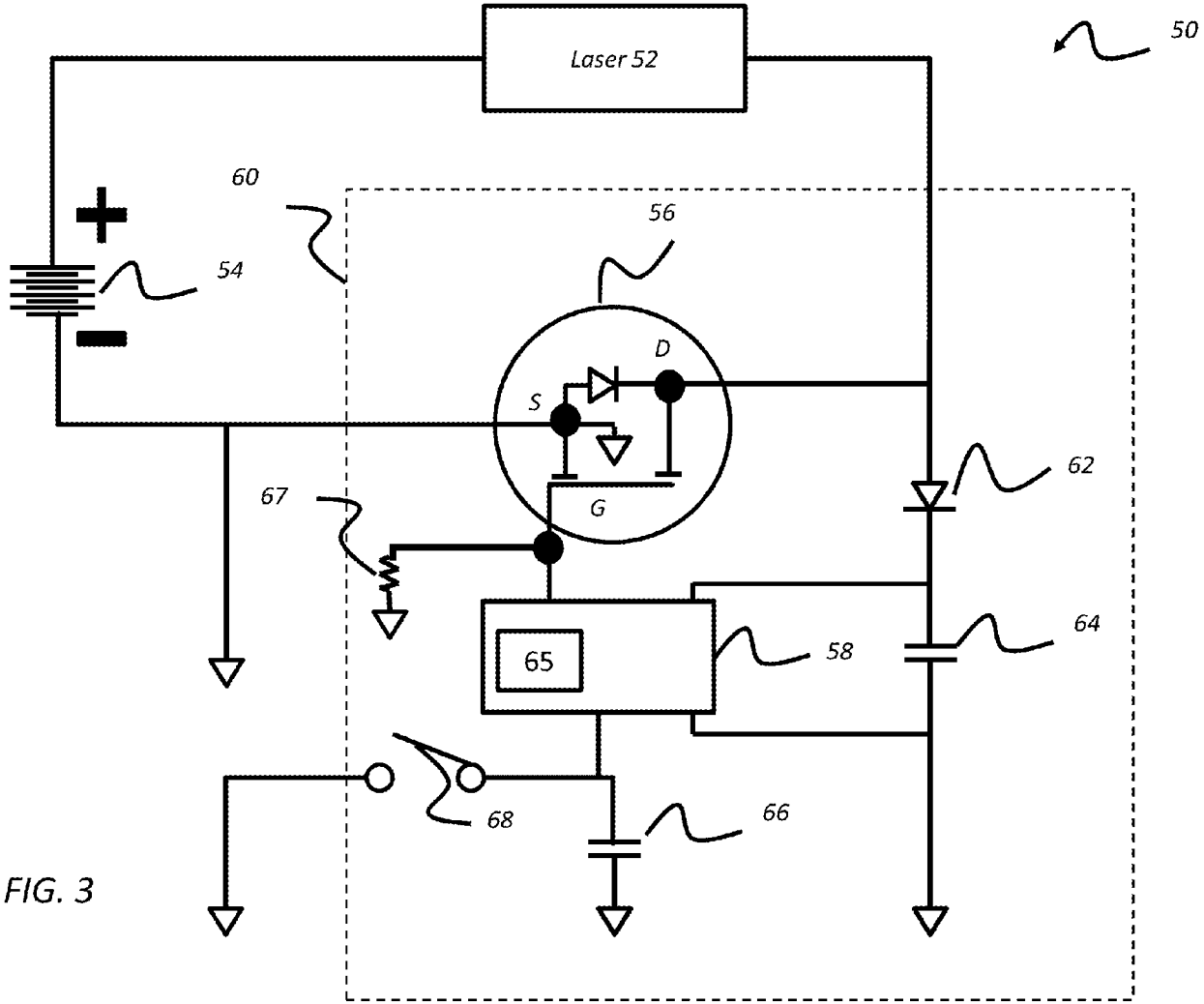
FIG. 3 illustrates an electrical schematic for one embodiment of a circuit useful in a spring guide rod laser.

With reference to FIG. 3 what is shown is a first embodiment of a driver circuit 50 for use in driving a laser 52 and that can usefully be employed for example in a spring guide rod laser sight 40. In this embodiment, driver circuit 50 includes laser 52, battery unit 54, a transistor 56, and a control system 60 comprising in this embodiment, a microcontroller 58, a diode 62, a first capacitor 64, a second capacitor 66 and a switch 68. Transistor 56 allows current to flow between source S and drain D in accordance with a voltage level at a gate G. When gate G is at a comparatively higher voltage level, current flows between source S and drain D such that laser 52 can emit light. When gate G is at a relatively low voltage level, there is insufficient current to allow laser 52 to emit light. Gate G is electrically connected to an output of microcontroller 58 such that microcontroller 58 can control the voltage at gate G. Gate G is also connect to ground by way of resistor 67 to help ensure that the voltage at gate G does not rise to the higher voltage level when microcontroller 58 is unpowered for example when battery unit 54 is being change or fully depleted.

In this embodiment, microcontroller 58 is selected from a class of microcontrollers that have low power consumption requirements examples of which include the programmable ATtiny4, ATtiny5, ATtiny 9 and ATtiny 10 microcontrollers sold by Atmel. This is not limiting and other microcontrollers of this class can be used. Such microcontrollers 58 can enter a power down mode that draws less than 1 microamp at 1.8 VDC. In the embodiment that is illustrated, diode 62 and capacitor 64 cooperate to maintain a voltage and a supply of current sufficient to maintain micro-controller 58 in the power down mode even when laser 52 is not emitting light. The current necessary to maintain a voltage across capacitor 64 is supplied by current leaks from battery unit 54 through laser 52. This creates a supply of power across capacitor 64 that can supply the voltage and current required to keep microcontroller 58 in the power down mode for an extended period of time without fully draining battery unit 54. It will be appreciated that when laser 52 is active, first capacitor 64 is effectively shunted. During such times, power to operate microcontroller 58 is supplied by power from capacitor 64. Accordingly, capacitor 64 has sufficient capacity to operate microcontroller 58 for the extent of each micro-pulse. From this it will be appreciated that the use of micro-pulses 100 further allows capacitor 64 to be smaller than would be required in the event of continuous or pulsed operation of the prior art which requires emission pulses that can operate for substantial periods of time.

Given the low drain on battery unit 54 required to maintain microcontroller 58 in the powered down mode, it is possible for microcontroller 58 to remain in the powered down state for a significant period of time without exhausting battery unit 54. This allows microcontroller 58 to transition from the powered down state to an idle mode or active mode in a manner that is more controlled than might occur if control system 60 required microcontroller 58 to transition to the active state by reactivating from an unpowered state.

Control system 60 has non-volatile memory 65 which in this embodiment is integrally located within microcontroller 58 but that in other embodiments may be external thereto. Non-volatile memory 65 is used to store programs that can be executed by microcontroller 58.

Figure 4:
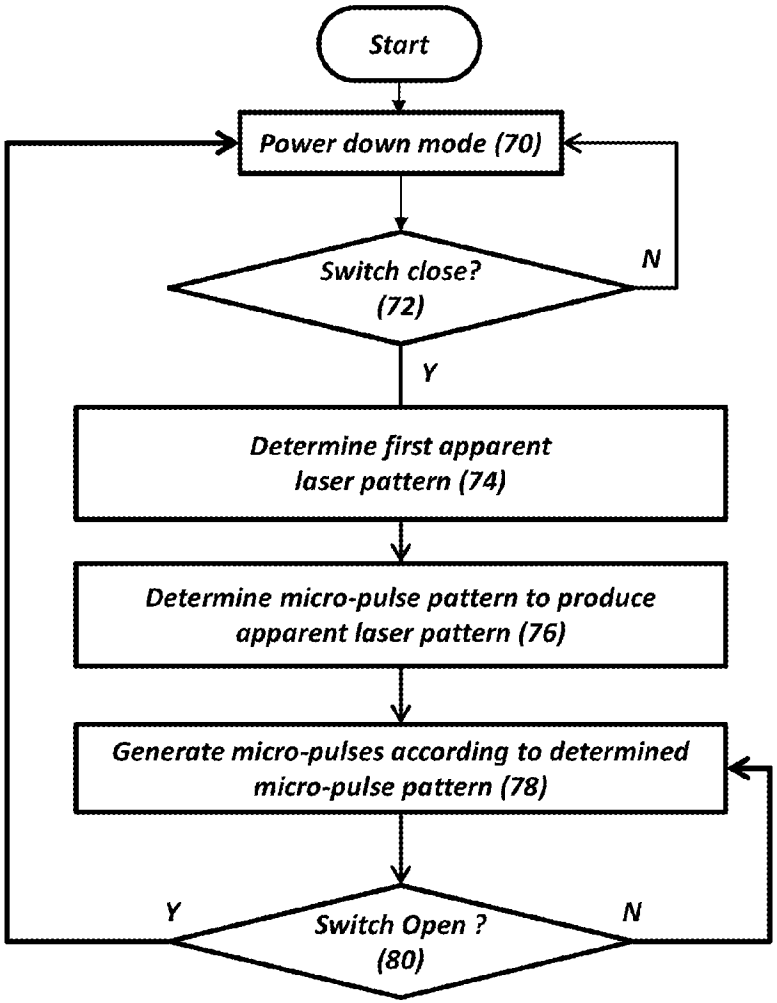
FIG. 4 is a flow chart for operating a spring guide rod laser.

FIG. 4 illustrates one example embodiment of a method for controlling laser 52. As is shown in FIG. 4, the process begins with microcontroller 58 in a powered down mode. When switch 68 closes, microcontroller 58 activates and determines a laser appearance pattern (step 70). The laser appearance pattern is a pattern of light emission intensity changes that will be perceived by the human eye while observing the laser emission over time. This pattern of light emission may be a periodic perceived appearance pattern where the intensity of the observed light emitted by laser 52 appears to change periodically over time or a continuous apparent appearance pattern where the light emitted by laser 52 appears to be constant over time. Some firearm users prefer continuous light emission while others prefer periodic emission and still others prefer to select the pattern based upon a situation in which the laser will be used.

Figure 5A:
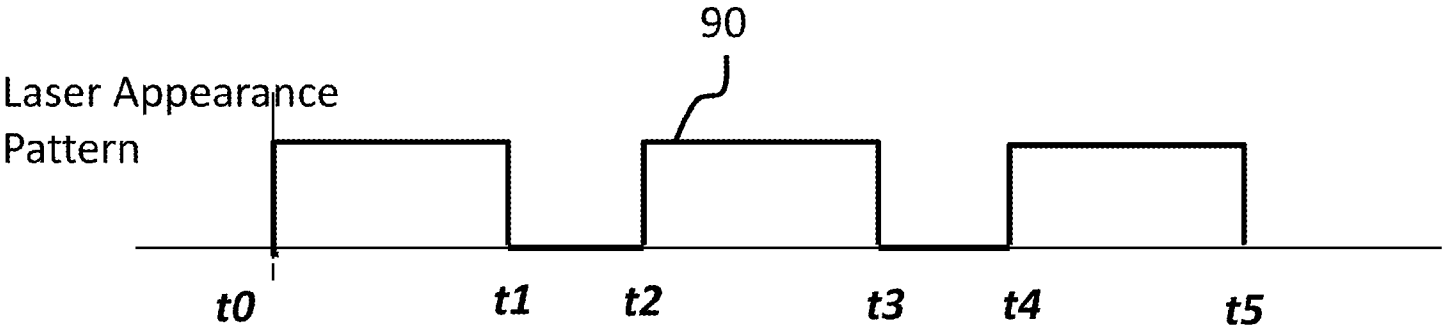
FIGS. 5A and 5B illustrate apparent laser illumination patterns.
Figure 5B:
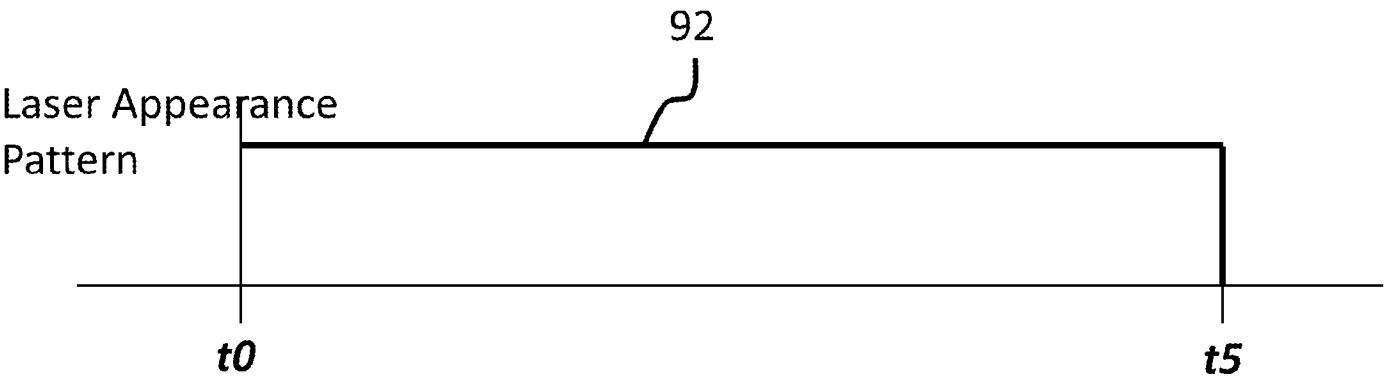

FIGS. 5A and 5B respectively illustrate a periodic laser appearance pattern in which the laser emission appears and disappears at a frequency of, for example, about 10 Hz and a continuous laser appearance pattern in which the laser emission appears and maintain a substantially constant observable intensity from a moment of activation to a moment of deactivation of laser. As is shown in FIG. 5A in a periodic laser appearance pattern 90 an observer will perceive a laser dot from t0 to t1, from t2 to t3 and from t4 to t5. Conventional spring guide rod laser aiming devices have provided such periodic appearance patterns by drawing continuously on battery unit 54 from time t0 to t1, from t2 to t3 and from t4 to t5. The frequency of a periodic appearance pattern is one that is substantially recognizable to the human eye. Such frequency can be between 8 and 12 Hz and is preferably at approximately 10 Hz. Further, the periodic laser appearance pattern 90 may be chosen to be at a frequency and duty cycle that takes advantage of any refresh characteristic of battery unit 54.

However, it will be understood that while periodic laser appearance patterns may offer some recovery time for a battery, they still impose significant draw on the battery during periods of activation simply by applying a continuous draw on battery unit 54 from t0 to t5 during active portions of their duty cycle. Such continuous draws can significantly reduce battery life.

Figure 1A:
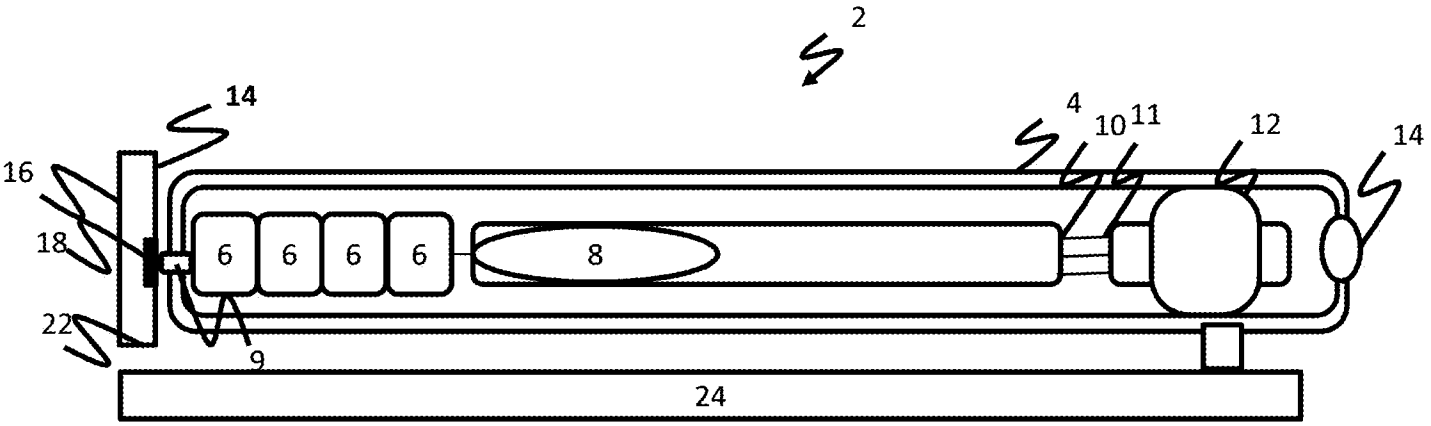
FIG. 1A PRIOR ART
FIGS. 1A and 1B are block views of a prior art spring guide rod laser.
Figure 1B:
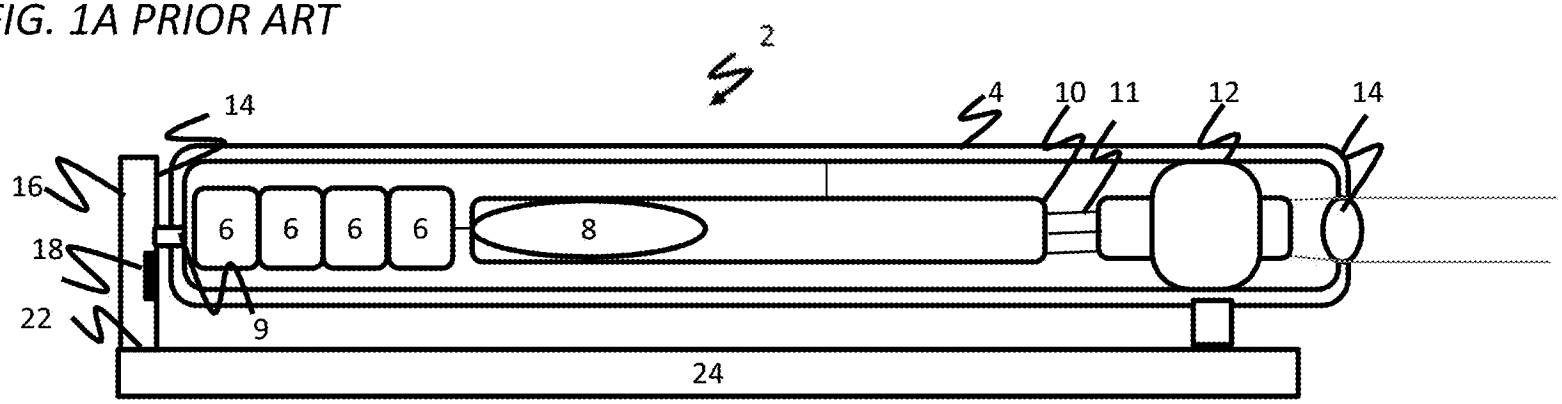
FIG. 1B PRIOR ART

To reduce this effect, prior art as shown in FIGS. 1A and 1B interposes a powerful capacitor 8 between batteries 6 and circuit 10. Capacitor 8 reduces the extent of the drain on battery unit 54. However, capacitor 8 typically occupies a significant portion of the volume within prior art housing 4, and adds expense and complexity to the spring guide rod laser.

The inventors, however, have developed another approach based upon the unique characteristics of human visual perception. In this regard, it will be understood that human visual perception is a function of a process known as visual phototransduction by which light is converted by sensors in the eye into electrical signals usable by the human brain and by various memory and processing features and capabilities of the human brain. As a result the brain will perceive laser emitted light as being continuous under certain circumstances even when the light that is being emitted is not continuous.

What the inventors have determined that it is possible to use this characteristic of human visual perception to allow a spring guide rod laser to be operable in more than one mode to emit a laser beam that has either a continuous or a pulsed appearance without necessarily imposing a large continuous drain on batteries and while eliminating the need for high-capacity capacitors. In the embodiment illustrated in FIGS. 3-9 this is done by driving laser 52 to generate very brief micro-pulses that are individually visually indistinguishable but are arranged to be emitted in serial so that when a series of these micro-pulses is viewed in sequence they have the appearance of a continuously emitted laser beam.

Figure 6A:
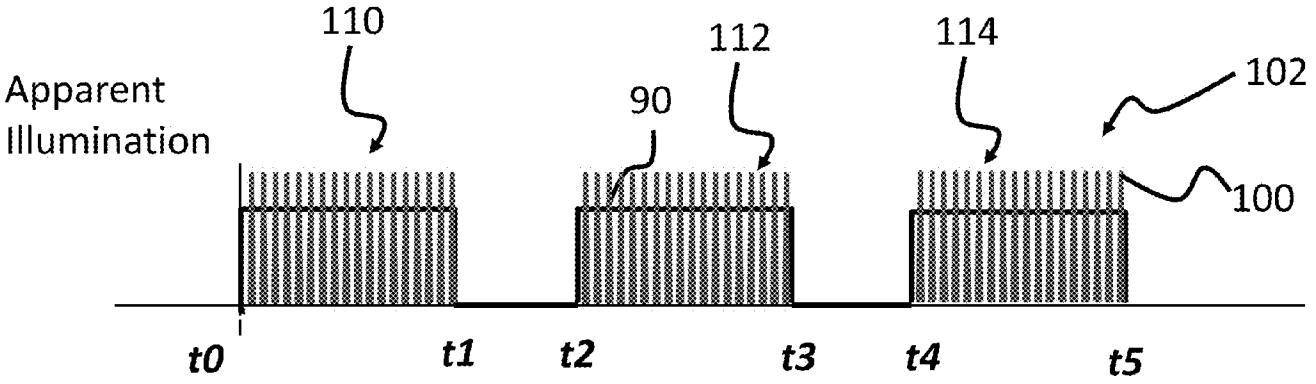
FIGS. 6A and 6B illustrate apparent laser illumination patterns and micro-pulses.
Figure 6B:
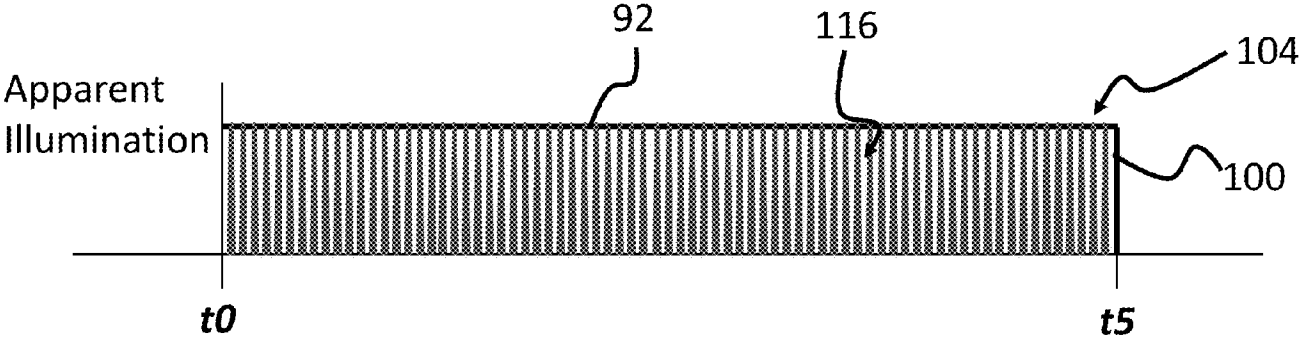

FIG. 6A illustrates a pattern 102 of micro-pulses 100 that can be used to form periodic laser appearance pattern 90 of FIG. 5A, while FIG. 6B illustrates a pattern 104 of micro-pulses 100 that can be used to form the continuous laser appearance pattern 92 of FIG. 5B. In FIG. 6A an example micro-pulse pattern 102 is shown that comprises a first set 110 of micro-pulses 100 transmitted from t0 to t1 followed by an absence of pulses from t1 to t2, a second set 112 of micro-pulses 100 transmitted from t2 to t3, followed by an absence of pulses from t3 to t4 and a third set 114 of micro-pulses 100 transmitted from t4 to t5. In FIG. 6B, an example micro-pulse pattern 104 is shown that comprises a set 116 of micro-pulses 100 that extend from t0 to t5 to provide what appears to be a continuous laser emission from t0 to t5.

It will be appreciated that the number of micro-pulses 100 and relative frequency of micro-pulses 100, the duty cycle of micro-pulses 100, the waveform of micro-pulses 100 and the amplitude of micro-pulses 100 illustrated in FIGS. 6A and 6B is for illustration purposes and may vary widely depending on the requirements for a particular laser or application. Similarly the term micro-pulses is not necessarily limiting but rather used herein to discriminate between visually apparent laser emissions that have patterns that change over time in ways that are visually apparent such the periodic laser appearance pattern 90 shown in FIG. 5A and micro-pulses 100 that are not visually apparent as individual pulses when emitted in patterns of more than one micro-pulse 100. That is, in some embodiments it may be possible for a user to perceive an isolated micro-pulse 100 however, when a sequence of micro-pulses 100 is provided a user will perceive the pulse sequence as being continuous.

In part this occurs because, micro-pulses 100 have an amplitude, waveform, duty cycle and frequency that are defined so that when a given set of micro-pulses 100 is generated, laser 52 will emit light that appears to be continuous. In application micro-pulses 100 can have a duty cycle of about 10 to about 70 percent and a frequency from about 40 Hz to 10000 Hz depending on the characteristics of laser 52. In other embodiments micro-pulses 100 can have a duty cycle of at least 25% to at least 60%.

In the embodiment that is illustrated, microcontroller 58 generates signals—either a lower voltage signal or a higher voltage signal that control operation of gate G of transistor 56. No current flows between source S and drain D and the laser 52 emits no light when this occurs. However, when microcontroller 58 generates the higher voltage signal at gate G, current flows between source S and drain D and laser 52 emits. The actual waveform generated by laser 52 depends upon the duty cycle and frequency at which microcontroller 58 generates high voltage signals as well as characteristics of battery unit 54, transistor 56 and other components of driver circuit 50.

By using micro-pulses 100 rather than continuous draws of current from a battery unit 54, battery unit 54 is allowed intervals of non-use during which battery unit 54 can at least partially recover from the demands of a previous micro-pulse 100 before a subsequent pulse begins. This in turn can help to ensure that battery unit 54 lasts longer and operates better using micro-pulses 100 to form an apparent laser pattern than battery unit 54 does in a continuous mode of operation. Further, in some embodiments, small capacitors 64 that occupy less than for example and without limitation one quarter or one fifth of the volume of prior art large capacitors can be used to supply a portion of the current required during micro-pulses 100. It will be appreciated that capacitors have a rapid rate of discharge and that in some embodiments, the length of micro-pulses 100 may correspond more closely with the discharge rate of smaller capacitors 64 allowing the more effective and efficient use of such capacitors than is possible in the prior art where current is drawn for significantly longer periods of time.

Returning now to FIG. 4, after the pattern of micro-pulses 100 is determined (step 76) using the pattern of apparent pulses, control system 60 causes laser 52 to emit light in accordance with the determined patter of micro-pulses (step 78). In the embodiment of control system 60 shown above, micro-pulses 100 are generated when microcontroller 58 sets the voltage level at gate G at a high voltage level. Accordingly, in one embodiment, microcontroller 58 can act to cause emission of a continuous stream of micro-pulses 100 if a continuous apparent laser pattern is determined and alternatively can act to cause a continuous stream of micro-pulses 100 to be emitted and subsequently introduce periods where the continuous stream of micro-pulses 100 is interrupted if a periodic apparent laser pattern is determined. The periods of delay can be pre-programmed and executed at fixed timings according to a timer which may be provided in control system 60 or can be accomplished by interrupting the stream of micro-pulses 100 after a predetermined number of micro-pulses 100 has been emitted.

In various embodiments, any of the amplitude, waveform, duty cycle and frequency of micro-pulses 100 used in forming a continuous laser appearance pattern 92 can be different from any of the amplitude, waveform, duty cycle and frequency of the micro-pulses 100 used in forming a periodic apparent laser pattern 90. This can be done for example, to enhance visibility, to lower power consumption, to manage heat generated by the laser emission, to utilize recovery periods provided by non-illumination periods in a periodic illumination pattern or to better match performance characteristics of laser 52 with performance characteristics of battery unit 54 for other reasons. For example, the duty cycle of micro-pulses 100 used during a periodic laser appearance pattern 90 can be up to 150% larger or smaller than that used during in a continuous laser appearance pattern 92.

As is shown in FIG. 4, micro-pulsed laser emission to create the apparent periodic illumination continues until switch 68 opens (step 80). In the embodiment of FIG. 4, when switch 68 opens, control system 60 returns microcontroller 58 to the power down mode (step 70). It will be appreciated that in this way, large capacitors of the prior art can be eliminated. This enables spring guide rod laser to be made smaller, less complex and less expensive.

Figure 7:
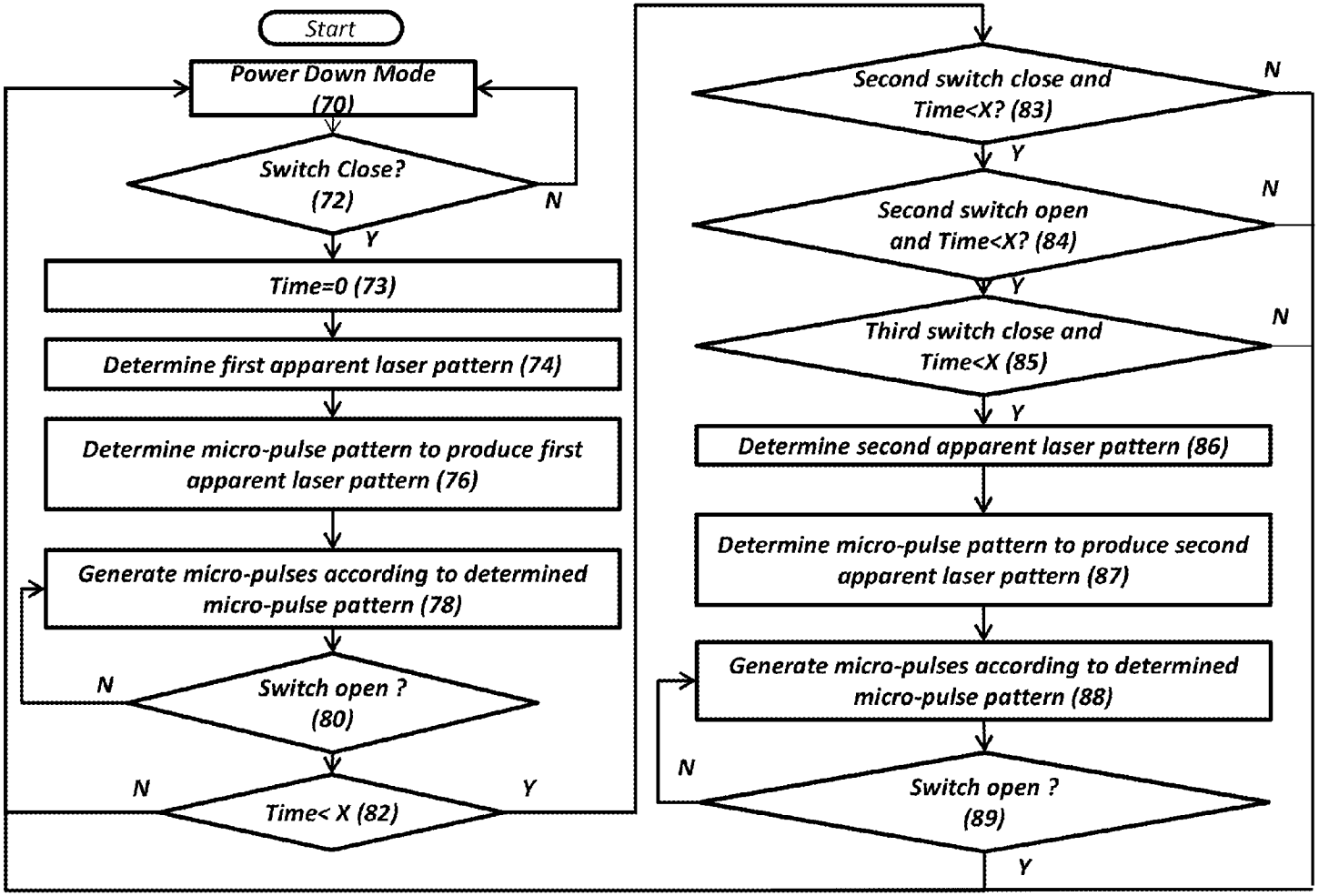
FIG. 7 illustrates another flow chart for a spring guide rod laser.

FIG. 7 illustrates another embodiment of a method for operating laser 52. This embodiment allows a user to select from between at least two different apparent laser emission patterns from outside of a firearm having the spring guide rod laser. In this embodiment, steps 70-78 can be performed as described above however, this embodiment is adapted to sense when switch 68 is closed three times within a predetermined time period. Accordingly, when a first switch close is detected (step 72) an additional step of determining at time or setting a time based counter is performed (step 73). If switch 68 is then closed again (step 82) within a predetermined time period following step 73 and represented in this flow chart by the letter X, then control system 60 is adapted to detect whether switch 68 is closed for a second time within predetermined time period X (step 83), whether switch 68 is opened again within predetermined time period X (step 84) and whether switch 68 is closed again within predetermined time period X (step 85). If any of the conditions in steps 82-85 is not met, control system 60 determines that a first apparent laser pattern is to be used (step 74), determines a micro-pulse pattern to produce the first apparent laser pattern (step 76) and generates micro-pulses to form the first apparent laser pattern (step 78). However, if all three conditions are met, control system 60 determines that a second apparent laser pattern is to be used (step 86), determines a micro-pulse pattern to produce the second apparent laser pattern (step 87) and generates micro-pulses according to the determined micro-pulse pattern (step 88). The generation of micro-pulses continues until the switch opens again (step 89).

In this manner control system 60 enables a user to select a mode of operation based upon inputs to switch 68. It will be appreciated that this is in part enabled by designing circuit 50 and control system 60 to allow microcontroller 58 to enter a power down mode step 70 rather than powering microcontroller 58 down at times between the opening of switch 68 and the closing of switch 68. It will also be appreciated that there are many possible variations regarding this design, such as determining the second apparent laser pattern 98 after switch 68 has been turned on, then off, then on again. Additionally, it will be appreciated that it is possible to use this technique to select from between more than two different modes of operation based upon the number of times that switch 68 is transitioned between a closed position, an open position and back to a closed position. Further, it will be appreciated that in an alternative embodiment, it may not be necessary to determine a time but rather to use other metrics such as a number of clock cycles and a number of micro-pulses generated.

Figure 8:
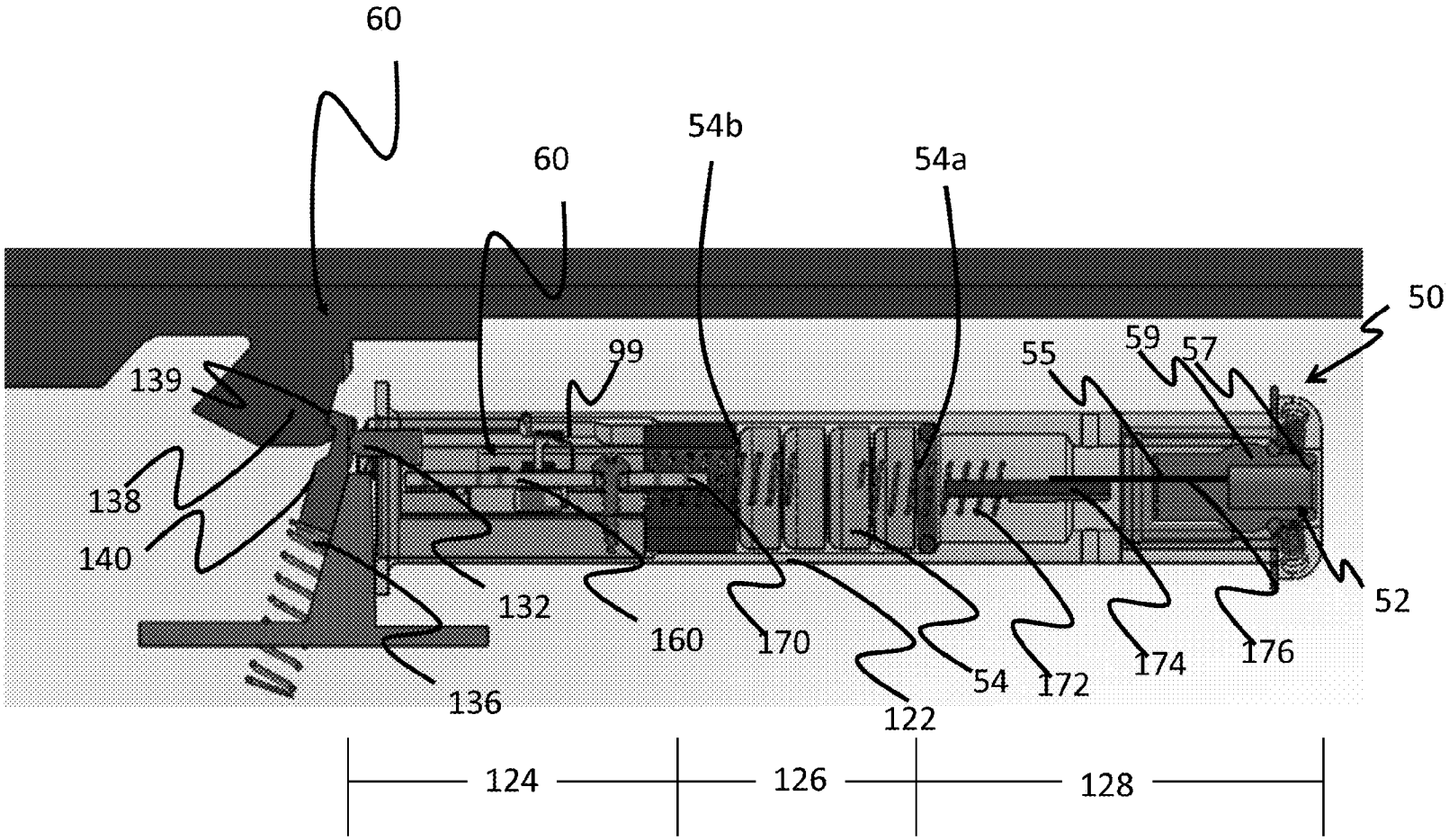
FIG. 8 illustrates an embodiment of a spring guide rod laser.

FIG. 8 illustrates a side cross-section view of an embodiment of a spring guide rod laser sight 40 that in this embodiment incorporates circuit 50. As can be seen in this embodiment, spring guide rod laser sight 40 has a different architecture than that of the prior art spring guide rod laser 2. As is shown in FIG. 8, in spring guide rod laser sight 40, battery unit 54 is located within a central portion 126 of housing 122 while control system 60 is located on a first end portion 124 and laser 52 and optics 57 are located at a second end portion 128.

In this embodiment battery unit 54 is electrically insulated from housing 122 in central portion 126 and a first terminal 54*a* of battery unit 54 is connected to laser 52 by way of a single connector 55 which may include as illustrated a spring 172 and intermediary board 174 and terminal 176. Laser 52 has an electrically conductive shell 59 that is electrically connected to housing 122 which is also electrically conductive. A second terminal 54*b* of battery unit 54 is connected to control system 60 and control system 60 is in contact with housing 122 to complete control system 60. In order to make an electrical circuit between battery unit 54 and laser 52 it is necessary for control system 60 to provide an electrical path between housing 122 and battery unit 54. In the embodiment illustrated in FIG. 8, a resilient member 99 is used to provide a mechanical and electrical connection between housing 122 and a board 160 on which control system 60 is positioned. This can be done in the manner described above with transistor 56 having a drain D connected to housing 122 and a source S connected to battery unit 54 and with microcontroller 58 generating a higher voltage at a gate G of transistor 56 whenever a micro-pulse 100 is desired. In the embodiment that is illustrated in FIG. 8, a spring 170 is used to make electrical contact between housing 122 and control system 60 completing a return path from laser 52 without passing electrical current through any components outside of spring guide rod laser 120.

In the embodiment that is shown in FIGS. 3-8, an electrical switch 68 is required in order to activate, deactivate laser 52 and optionally to select a laser appearance pattern. Switch 68 must be of a design that allows a user to activate it when spring guide rod laser sight 40 is installed in firearm 20. However, switch 68 must be capable of maintaining a setting even during firing of firearm 20, must be capable of repeated use and must be capable of allowing a setting to be made without allowing contaminants to enter housing 122. Additionally, for the reasons discussed in greater detail above it is useful not to require components outside of housing 122 to be used as part of the electrical circuit with laser 52.

Accordingly in this embodiment an original take down latch in firearm 20, is replaced by a modified take down latch 140 and a modified take down latch spring 136. Spring 136 biases take down latch 140 against a catch 139 of structure 141. Take down latch 140 is generally made of metal and has a central portion bordered by at least one raised areas. When take down latch 140 is centered, a movable pin 132 is held at a position that keeps switch 68 in the open position and microcontroller 58 in the power down mode. Movement of take down latch 140 from center brings a raised portion against pin 132 advancing pin 132 into housing 122 and closing switch 68.

Figure 9:
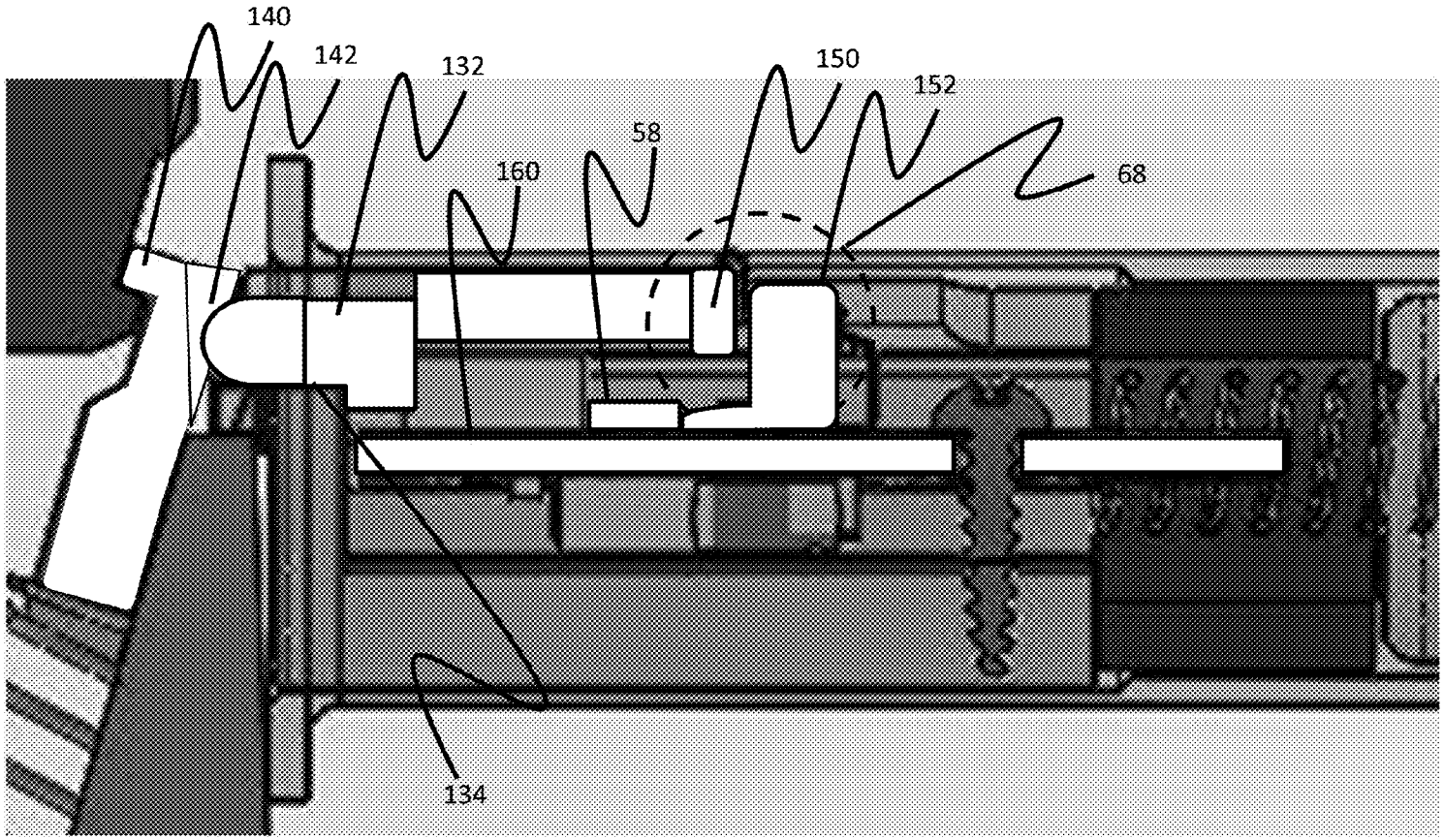
FIG. 9 illustrates an embodiment of a spring guide rod laser with a first switch arrangement in an open position.
Figure 10:
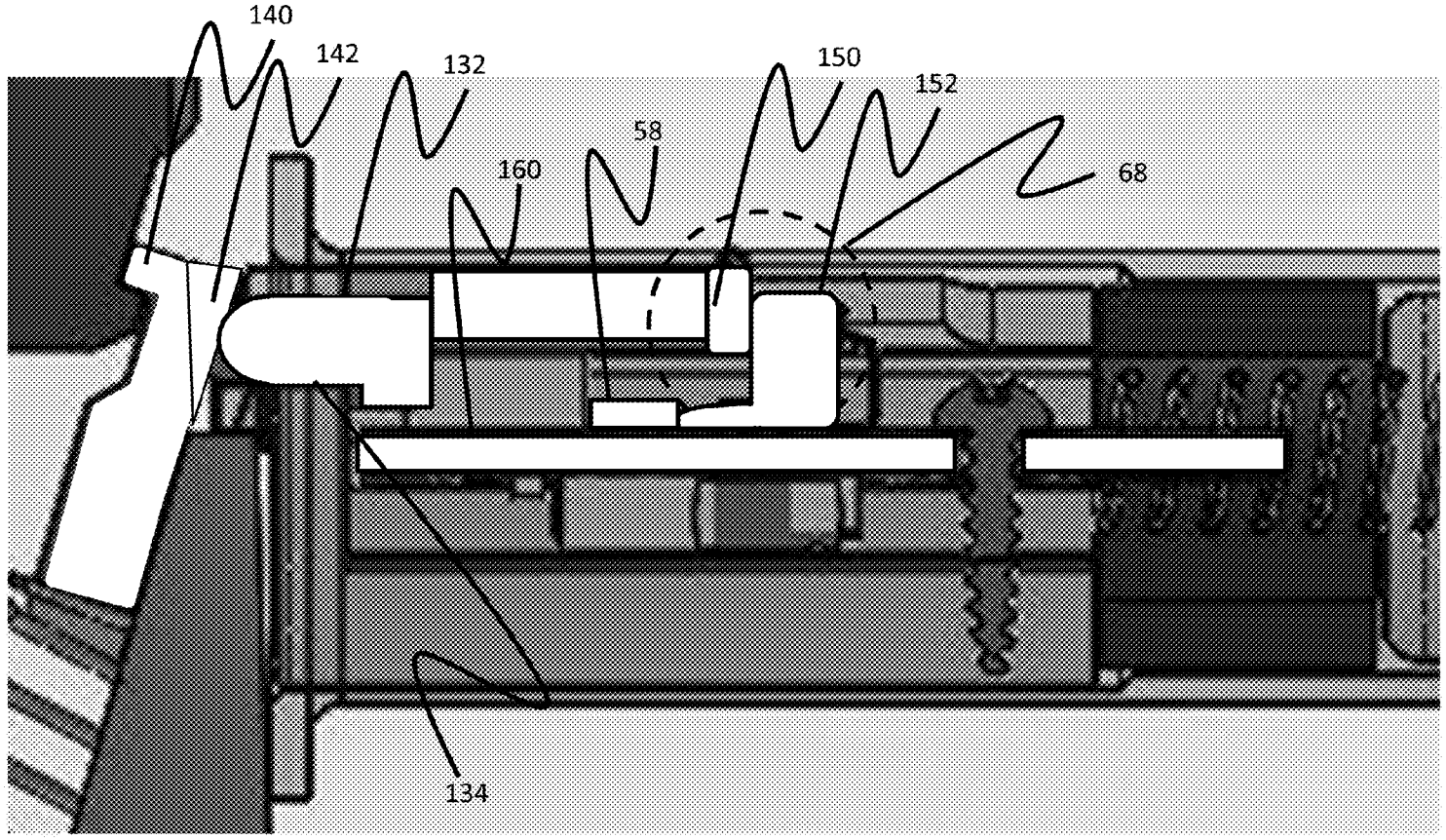
FIG. 10 illustrates the spring guide rod laser of FIG. 9 with the switch in a closed position.

FIG. 9 is a close up of one embodiment of a switch 68 of the present invention. As is shown in FIG. 9, a take down latch 140 is provided that is capable of sliding within a range of positions across a width of housing 122. Take down latch 140 has a raised area 142 that presses pin 132 into an opening 134. Pin 132 may move freely within an opening 134 of housing 122 to exit opening 134 as take down latch 140 is moved to different positions across the width of housing 122. As this occurs, pin 130 drives a movable first contact 150 of switch 68 that is electrically connected to housing 122 from a position that is not in contact with a second contact 152 on board 160 as is shown in FIG. 9 to a position where first contact 150 is in electrical contact with second contact 152 as shown in FIG. 10. This closes switch 68 and creates an electrical path between microcontroller 58 and ground bringing microcontroller 58 out of the power down mode. Such movement can be against a bias provided by a biasing member such as a spring.

Figure 11:
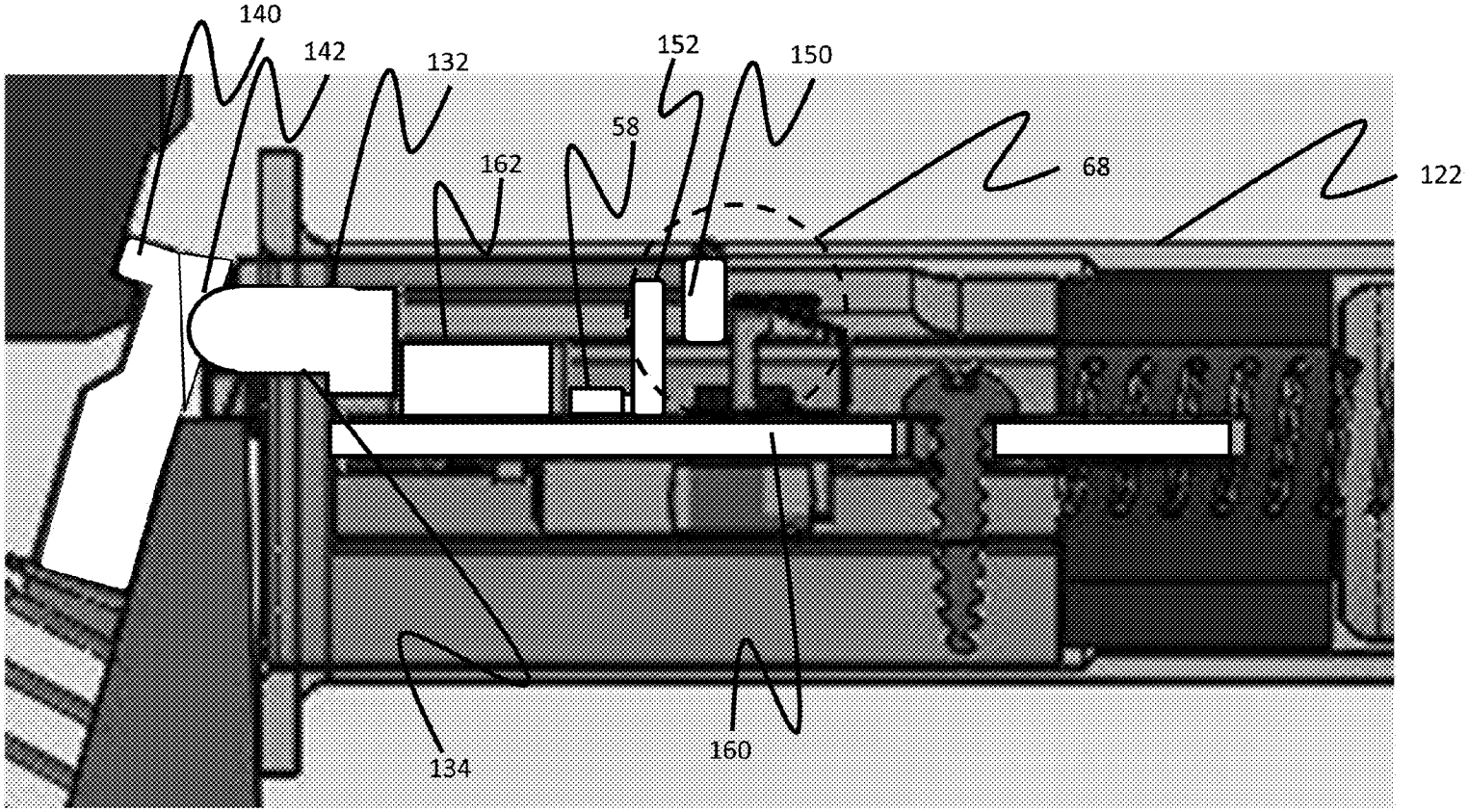
FIG. 11 illustrates an embodiment of a spring guide rod laser with a second embodiment of a switch in an open position.
Figure 12:
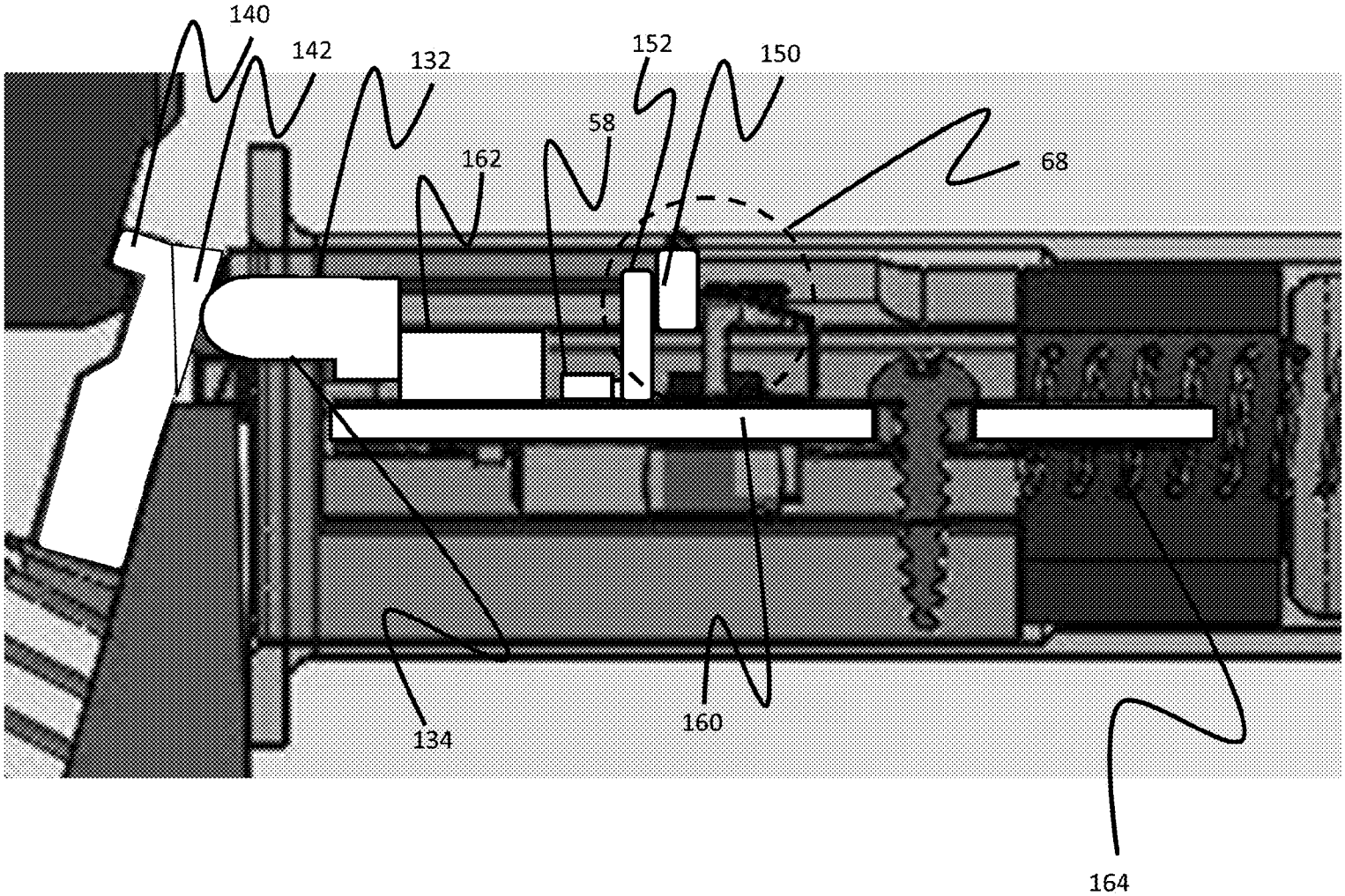
FIG. 12 illustrates the spring guide rod laser of FIG. 11 with the switch in a closed position.

FIGS. 11 and 12 illustrate another embodiment of switch 68. In this embodiment, switch 68 is operated in the same manner—in response to a sliding action of take down latch. However in this embodiment, a first contact 150 of switch 68 is in a fixed position relative to housing 122 and second contact 152 is in a fixed position relative to board 160. In this embodiment, board 160 is slidably movable along a length of housing 122 and pin 132 engages a contact member 162 on board 160 to move board 160 from a first position shown in FIG. 11 where a second contact 152 mounted to board 160 does not contact first contact 150 to a second position shown in FIG. 12 where second contact 152 is brought into contact with first contact 150. Such movement can be against a bias provided by a biasing member such as a spring 164. Other embodiments are possible, for example, in one embodiment either of first contact 150 or second contact 152 can be joined to pin 130. Additionally, it will be appreciated that the system can be made to work in the converse with switch 68 closing when pin 132 is fully extended from housing 122 and opening when pin 132 is pressed further into housing 122.

Figure 13:
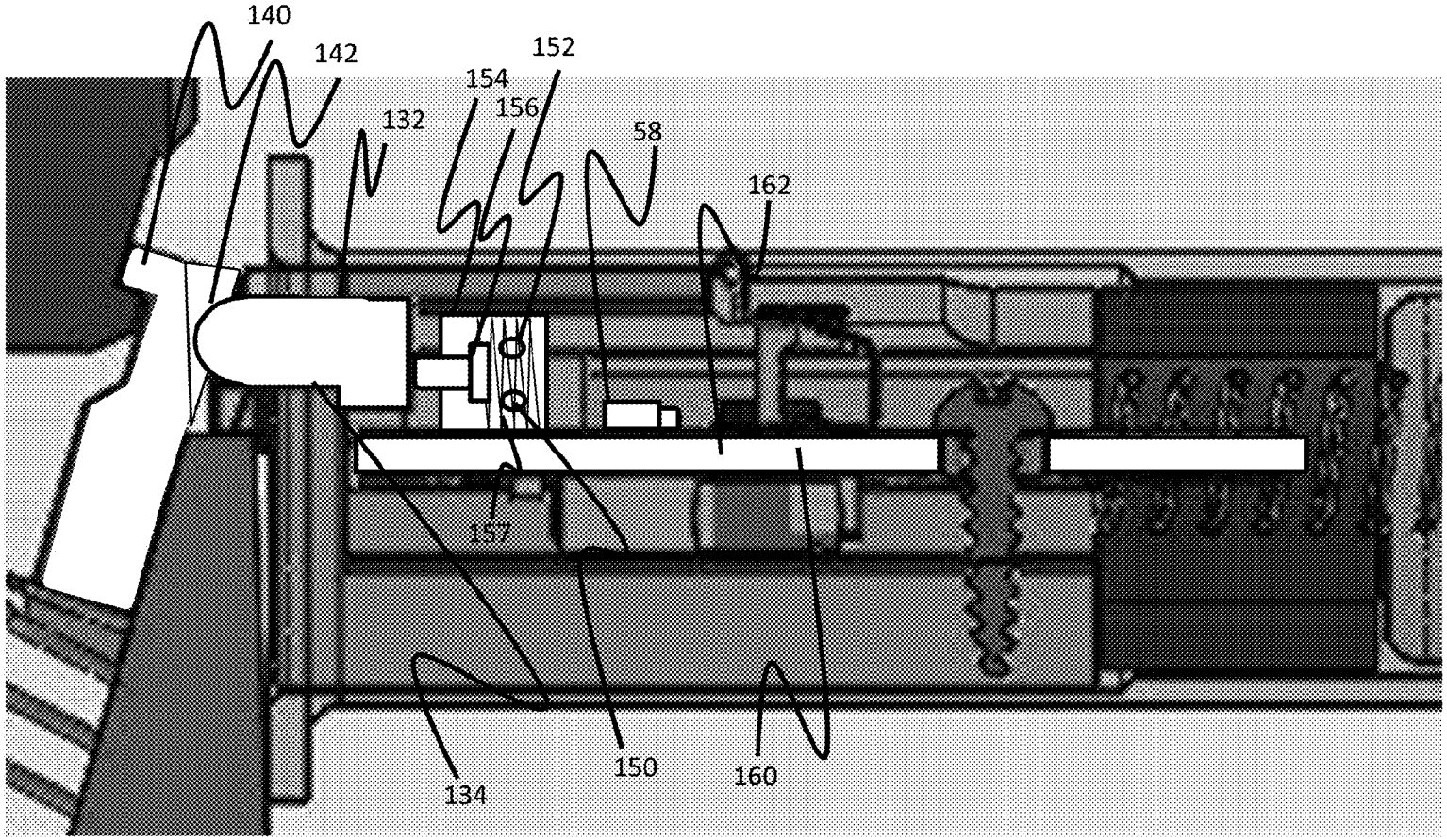
FIG. 13 illustrates an embodiment of a spring guide rod laser with a third embodiment of a switch in an open position.
Figure 14:
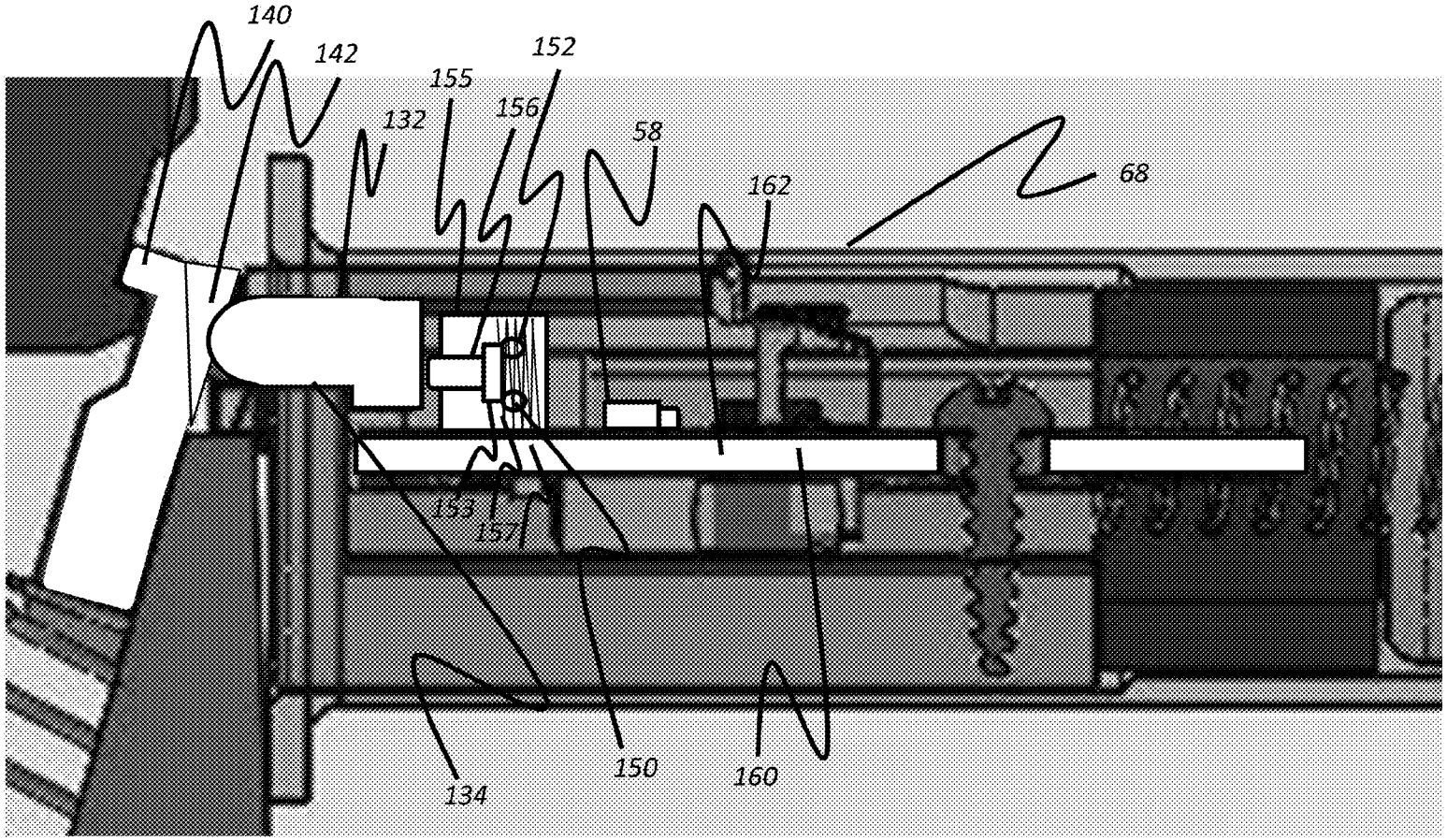
FIG. 14 illustrates the spring guide rod laser of FIG. 13 with the switch in a closed position.

FIGS. 13 and 14 illustrate another embodiment of the invention. In this embodiment, a micro switch 155 is provided to perform the function of switch 68 of FIG. 3 and is positioned so that movement of pin 132 causes micro switch 155 to change state. In this embodiment, micro switch 155 has a biasing member 157 such as a spring that drives micro switch plunger 156 and conductor 153 an open position shown in this embodiment as a position where a conductor 153 is separated from first contact 150 and second contact 152. However, when the bias is overcome by force transmitted during movement of pin 132 caused in turn by movement of take down latch 140 as shown in FIG. 13B, conductor 153 provides a conductive path between first contact 150 and second contact 152. Other types of known micro switches can be used for micro switch 155.

Figure 15A:
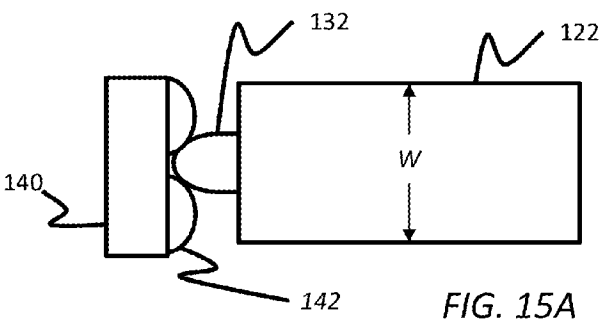
FIGS. 15A and 15B illustrate a first embodiment of a slide latch, housing and pin in a centered position and in a non-centered position.
Figure 15B:
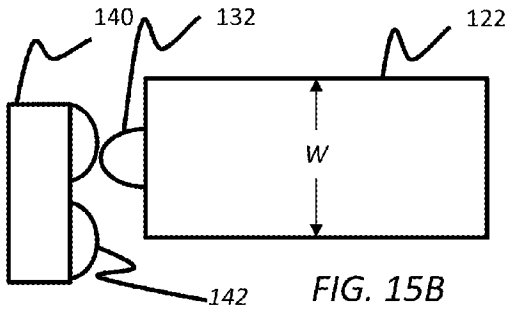

FIGS. 15A, 15B, 15C, 15D, 15E and 15F illustrate top views of various examples of the many different types of raised areas 142 that can be used on a take down latch 140 to engage a pin 132. As is shown in FIGS. 15A and 15B two raised areas 142 are provided having arcurate shape allowing take down latch 140 such that pin 132 is depressed or released continuously as take down latch 140 is moved across width W of housing 122.

Figure 15C:
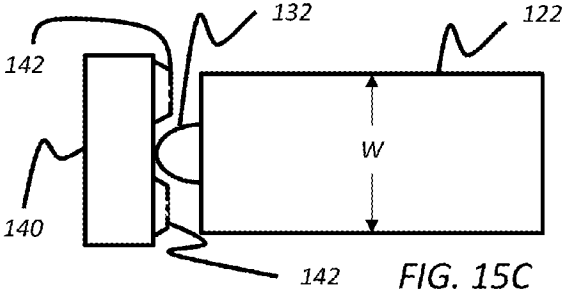
FIGS. 15C and 15D illustrate a second embodiment of a slide latch, housing and pin in a centered position and in a non-centered position.
Figure 15D:
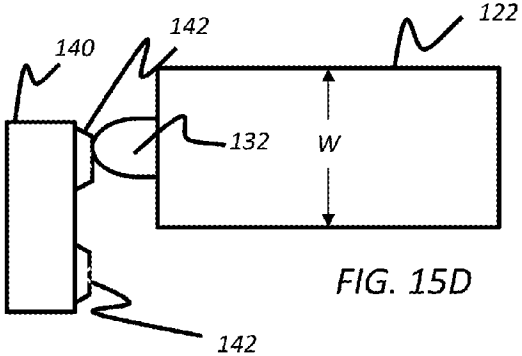
Figure 15E:
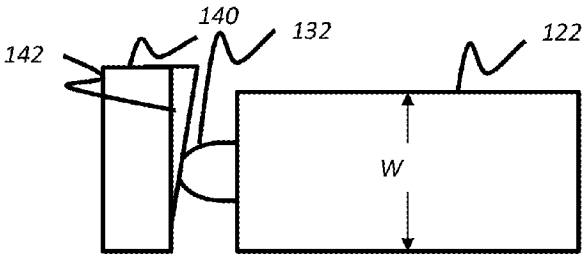
FIGS. 15E and 15F illustrate a third embodiment of a slide latch, housing and pin in a centered position and in a non-centered position.
Figure 15F:
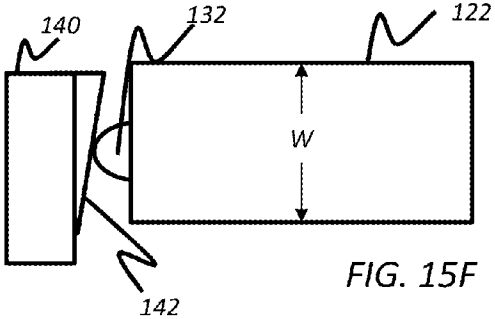

As is shown in FIGS. 15C and 14D raised areas 142 can include a sloped engagement surface 142A and a flat 142B that is reached when pin 132 has reached a predetermined extent of movement into housing 122. It will be appreciated that providing raised areas 142 that are shown in FIGS. 15A, 15B, 15C and 15D, allows bi-lateral activation of switch 68 in that they allow take down latch 140 to be moved in two directions across width W while achieving the same effect on pin 132. This advantageously allows a take down latch 140 to be moved across a width from a right side or from a left side of housing 122 in order to control the state of switch 68. However, this bi-directional capability is not necessary and as is shown in FIGS. 15E and 15F take down latch 140 can have a sloped raised area 142 that is arranged for movement in one direction only.

It will be appreciated that in the embodiments described above, opening 134 in housing 122 is, at all times, substantially occupied by pin 132. This works to prevent contaminants from the firearm discharge process, from firearm cleaning or other maintenance and from the environment in general from entering into housing 122 through opening 134 while allowing pin 132 to enter into and exit from housing 122. Further, it will be appreciated that the entire electrical path from laser 52 to control system 60 and battery unit 54 is within housing 122 thus preventing such contaminants from interposing themselves in the electrical path thereby further extending battery life as can occur when electrical paths outside of housing 122 are used.

Figure 16:
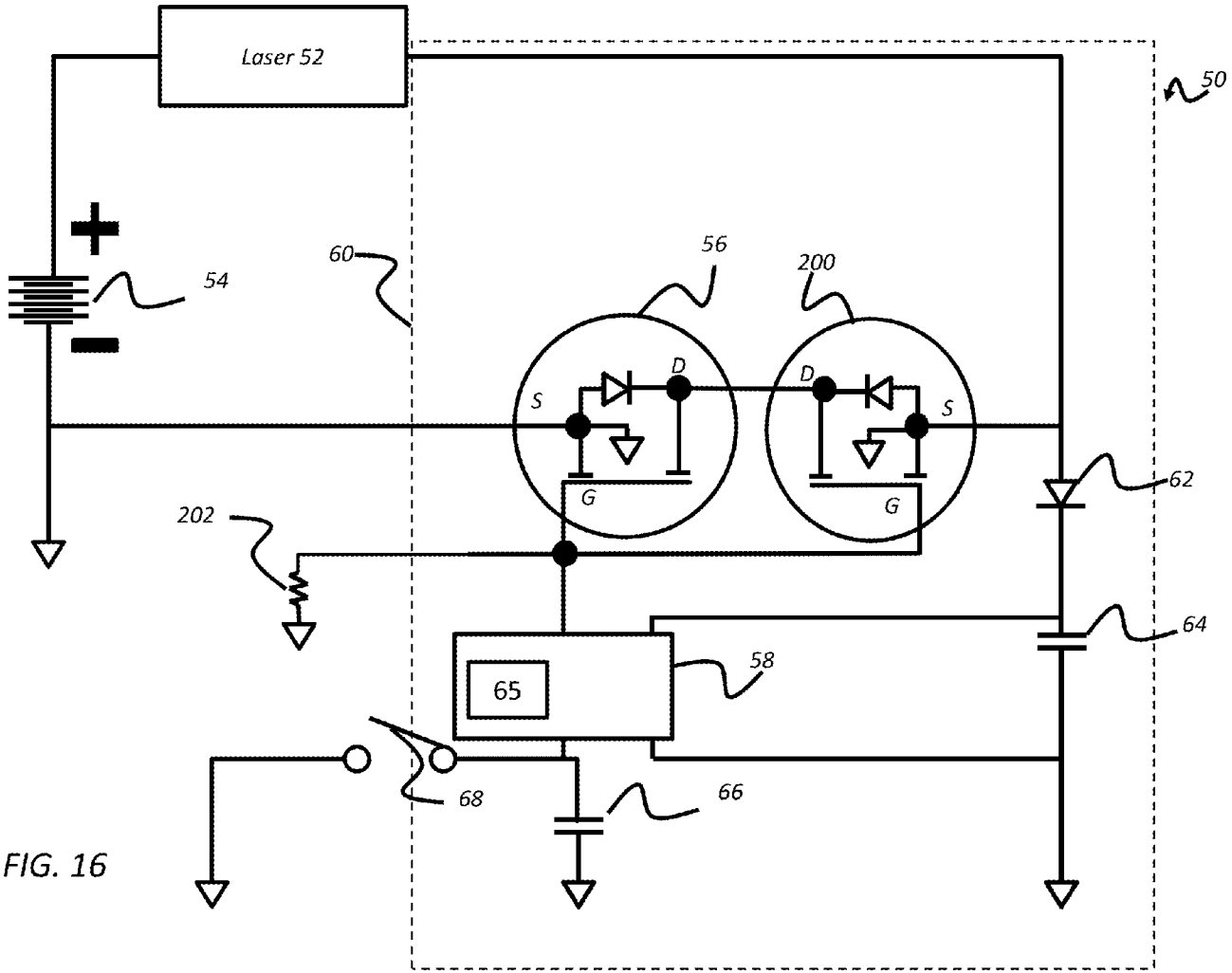
FIG. 16 illustrates another embodiment of a driving circuit.

FIG. 16 illustrates another embodiment of a driver circuit 50 for a spring guide rod laser sight 40. In this embodiment, driver circuit 50 has the same arrangement of functional components as described in the embodiment shown above, however, it also has a second transistor 200 that is arranged in combination with transistor 56 to provide reverse battery protection. In this regard drain D of transistor 56 is connected to drain D of second transistor 200, Gate G of transistor 56 and gate G of second transistor 200 are connected together, source S of transistor 56 is connected ground, and source S of second transistor 200 is connected between laser 52 and diode 62 so that if the battery unit 54 is connected backward, current cannot flow in an inverse direction to laser 52.

Figure 17A:
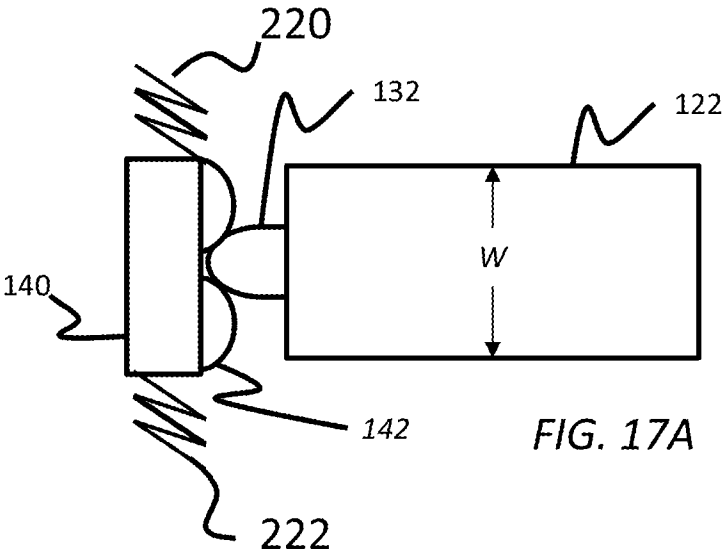
FIGS. 17A and 17B illustrate an embodiment of a center-biased take down latch useful in a tap-on/tap-off type of spring guide rod laser sight.
Figure 17B:
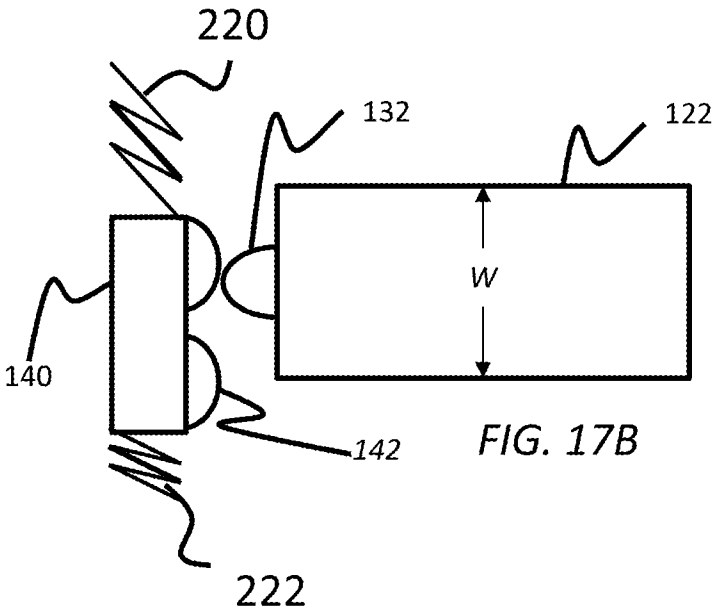

FIGS. 17A and 17B illustrate yet another embodiment in which take down latch 140 is biased by one or more biasing members into a centered position. That is unless a user actively presses against take down latch 140 against the bias, take down latch 140 will be biased to a centered position. In this embodiment two biasing members 220 and 222 are shown in the form of springs, however, other knowing resilient structures or substances can be used. In this embodiment, microcontroller 58 detects temporary transitions of switch 68 and reacts to these as a start of a new steady state condition and treats a subsequent temporary transition as an end of the steady state condition. That is rather than requiring that take down latch 140 be physically moved to a position that depresses pin 132 and held in this position while laser 52 is active, microcontroller 58 can sense a temporary depression of pin 132 and respond to the temporary depression as if the depression was maintained until the next temporary depression of pin 132.

Accordingly, for example, in the embodiment of FIG. 7, microcontroller 58 utilizing this approach to perform the method of FIG. 7, could interpret a first detected transition as a switch close (step 72), a second transition as a switch open (step 80), a third transition as a second switch close (step 83), a fourth transition as a second switch open (step 84), and a fifth transition as a third switch close (step 85). If all of these events occurred within time X of the first transition then the second apparent laser pattern would be used as is generally described above.

This approach advantageously allows "tap on/tap off" operation of spring guide rod laser sight 40 which does not rely on mechanical positioning of take down latch 140 to maintain a desired state of operation.

It will be appreciated that the spring guide rod laser sight 40 described herein offers any or all of a compact, efficient, externally adjustable and reliable laser design that can be uses as a spring guide rod in a firearm. It will also be appreciated that this is not limiting and that spring guide rod laser sight 40 be applied in other circumstances where a compact, efficient, externally adjustable or reliable laser is desired.

What is claimed is:

1. A laser system comprising:

a battery unit;

a housing mountable within a firearm;

a transistor having a source and a drain in series with the laser and the battery unit with the laser with the transistor having the source, and a gate that allows sufficient current to flow to the laser to allow the laser to emit light when a voltage at the gate is at a higher level and that does not allow sufficient current to flow to allow the laser to emit light when a voltage at the gate is at a lower level;

a microcontroller operable in an active mode and a reduced power mode having an activation input connected to a switch, a reduced power input connected in parallel with the capacitor and an output connected to the gate;

wherein when the switch changes from a first state to a second state, the microcontroller enters an active mode generating a plurality of micro-pulses at the gate such that an active current is supplied that cause the laser to emit a continuous plurality of micro-pulses that when viewed by a human observer provide an apparently continuous laser pulse; and wherein the microcontroller enters a power down mode, no micro-pulses are provided at the gate and a leakage current through the laser provides energy to maintain the processor in the power down mode of activation until the switch is again closed.

2. The laser of claim 1, wherein the leakage current is supplied to a diode that is in series with a capacitor and a ground that cooperate to maintain a voltage and a supply of current sufficient at the micro-controller to maintain the micro-controller in the power down mode.

3. The laser of claim 1, wherein battery unit is capable of storing sufficient energy for the micro-controller to operate for an extended period of time without draining the battery unit.

4. The laser of claim 1, wherein the capacitor has sufficient capacity to supply power to operate the micro-controller in the active mode for at least one micro-pulse.

5. The laser of claim 1, wherein the micro-controller can return from a powered down mode to an active mode in a more controlled manner than the microcontroller can return from an unpowered state.

6. The laser of claim 1, wherein the microcontroller has a non-volatile memory that stores programs that can be executed by the microcontroller.

7. The laser of claim 1, wherein the microcontroller is adapted to determine a laser appearance pattern based upon the number of sensed opening and closings of a switch within a predetermined period of time.

8. The laser of claim 7, wherein the microcontroller recalls the determined laser appearance pattern when transitioning from a powered down state to an active state.

9. The laser of claim 1, wherein the housing has an end with an opening that is substantially filled with a member movable in the opening between two positions to control the position of the switch and with the microprocessor sensing the position of the movable member and determining an operating mode based upon the movement.

10. The laser of claim 9, further comprising a firearm component that is modified to interact with the movable member and that can be moved from outside of an area of a firearm holding the spring guide rod so as to control the position of the movable member.

11. The laser of claim 10, wherein the firearm component is a slide latch.

12. The laser of claim 1, wherein the housing is operable as a firearm spring guide rod.

* * * * *